US005370306A

United States Patent [19]

Schulze et al.

[11] Patent Number: 5,370,306

[45] Date of Patent: Dec. 6, 1994

[54] COIN-OPERATED ENTERTAINMENT MACHINE

[75] Inventors: Ulrich Schulze, Wiesbaden; Horst Niederlein, Bingen, both of Germany

[73] Assignee: NSM Aktiengesellschaft, Bingen, Germany

[21] Appl. No.: 75,501

[22] PCT Filed: Dec. 6, 1991

[86] PCT No.: PCT/DE91/00960

§ 371 Date: Jun. 10, 1993

§ 102(e) Date: Jun. 10, 1993

[87] PCT Pub. No.: WO92/10818

PCT Pub. Date: Jun. 25, 1992

[30] Foreign Application Priority Data

Dec. 10, 1990 [DE] Germany ..... 4039317

[51] Int. Cl.[5] ..... G07F 17/32; A63F 9/24

[52] U.S. Cl. ..... 273/138 A; 273/371

[58] Field of Search ..... 273/138 A, 138 R, 143 R, 273/85 CP, DIG. 28, 433, 434, 371, 373

[56] References Cited

U.S. PATENT DOCUMENTS 5,217,224 6/1993 Sincock ..... 273/138 A
5,257,179 10/1993 DeMar ..... 273/138 A

FOREIGN PATENT DOCUMENTS

0219306A2 4/1987 European Pat. Off. .
2636253A1 2/1978 Germany .
3822636A1 1/1990 Germany .
3917684A1 12/1990 Germany .
1579687 11/1980 United Kingdom .
2170937A 8/1986 United Kingdom .
2201279A 8/1988 United Kingdom .
2205188 11/1988 United Kingdom ..... 273/138 A
2211975 7/1989 United Kingdom ..... 273/138 A
2218558 11/1989 United Kingdom ..... 273/138 A

*Primary Examiner*—Jessica J. Harrison
*Attorney, Agent, or Firm*—Spencer, Frank & Schneider

[57] ABSTRACT

A coin-operated entertainment machine includes a central control unit which permits the machine to be used at certain hours of the day or at certain days of the week at a reduced cost. In addition, the central control unit controls the machine in such a way that, with each use of the machine, a game of chance is automatically started, which gives the user the right to use the machine one or several times at no cost, should he win. Finally, the central control unit controls the machine in such a way that is possible to choose beforehand, by means of a selector, whether the end of the game depends on the occurrence of certain events during the game or on the end of a predetermined time interval.

4 Claims, 1 Drawing Sheet

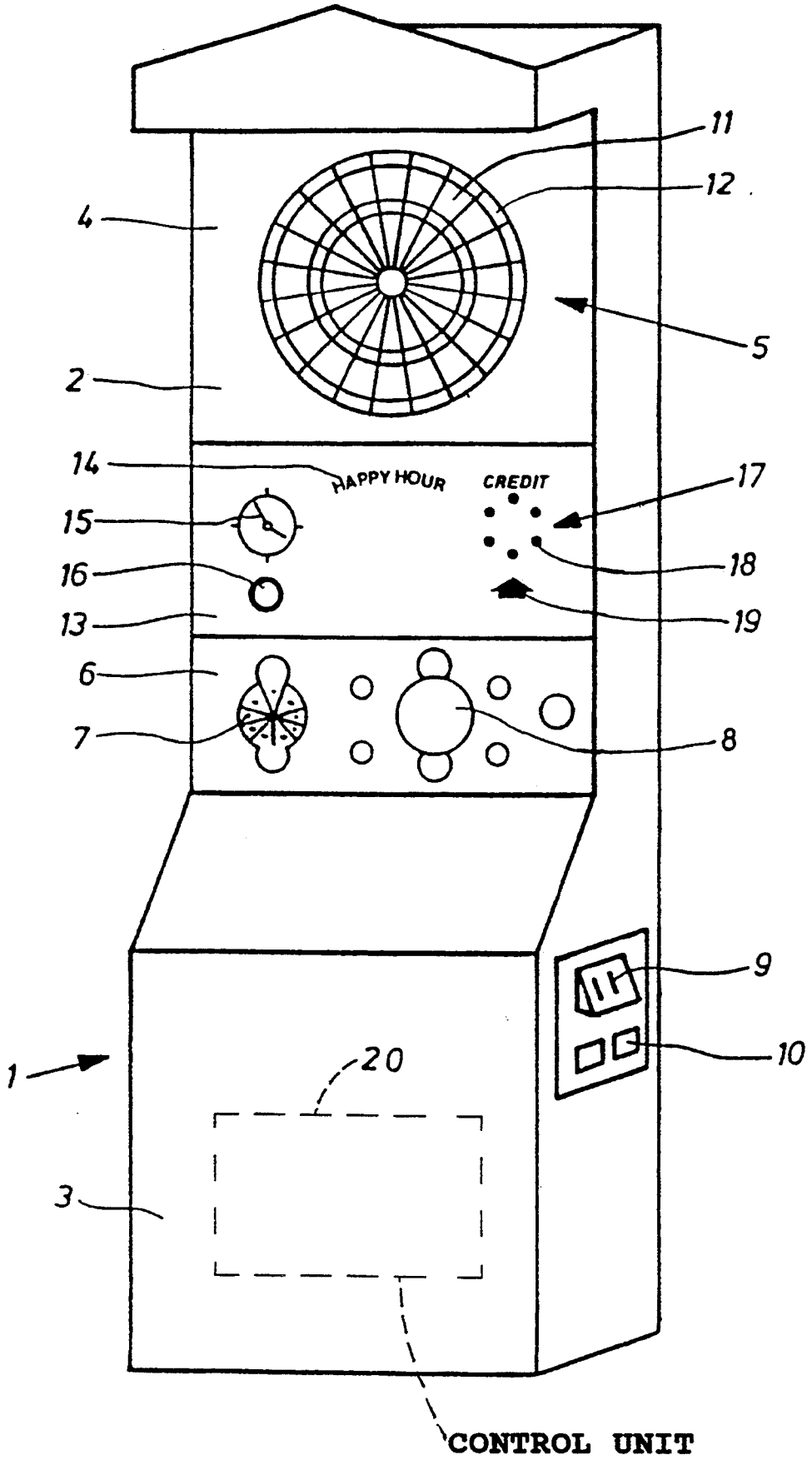
11
12
4
5
2
14
HAPPY HOUR
CREDIT
17
15
18
16
19
13
6
7
8
9
10
1
20
3
CONTROL UNIT

COIN-OPERATED ENTERTAINMENT MACHINE

BACKGROUND OF THE INVENTION

The invention concerns a coin-operated automatic entertainment machine comprising a gaming device and a central control device.

Automatic entertainment machines are set up in various forms. They are developed as gaming equipment with or without the possibility of financial winnings, as pin-ball machines with so-called flippers, as billiards, or equipment where darts are thrown, as video gaming devices, or the like. Already various measures have been achieved, to attract the user or player to the use of the various kinds of entertainment equipment, and to assist him to achieve a real corresponding entertainment during his period of play.

An automatic entertainment device is known, for example, from DE-38 22 636A1. This entertainment apparatus consists of a gaming unit having a gaming symbol device.

Gaming symbol devices have as a rule three rotating bodies which can take the form of drums, discs or carousels of flapping cards. Winning symbols are carried on surfaces which can be viewed through a window. The rotating bodies are stopped one after another, and after all have come to rest, the combination of symbols displayed in the viewing windows define a win or a loss. Different levels of prize winnings can feature money, points or special playing privileges. Such privileges could include a victory code, which would grant a higher than normal chance of a win. Many such gaming devices have actuating means such as touch buttons or levers for the player. These actuating means as a rule produce some effect on the movements of the individual rotating bodies. By these means the player is put in the position of being able, for instance, to start one or more of the bodies in the case of a START touch button, whereby the player can have a pronounced effect on the events taking place during the game. Also there are stop buttons installed, in order to give the player the possibility to halt one of the rotating bodies, which gives the player the impression that the course of play, and consequently the resulting combination of symbols displayed, can be influenced by him.

With such a gaming equipment, the real course of the games is controlled by a microprocessor. Moreover, preliminary or auxiliary games can be provided which run independently of the main gaming device and have a different character from the main play. For instance as a preliminary game a light spot can run around a circle, which simulates a roulette wheel. According to how the light spot comes randomly to rest, the player receives a greater or lesser sum of money credited to his account which has been set up in the gaming machine. These preliminary plays establish a variation, in that they raise the excitement and the recreational value of the gaming appliance. A disadvantage of this known form of gaming apparatus is that the preliminary game is only operable if the player inserts higher valued coins in the machine.

SUMMARY OF THE INVENTION

The invention is based on the objective of developing the course of the entertainment and on the possibilities of development in the gaming devices of this known art to give more alternatives and greater incentive to play, in order to increase the recreational value to the user.

This object is achieved by the invention in that the central control device controls the entertainment machine in such manner, that at certain times of the day or of the week, the entertainment device can be used at reduced cost.

By these proposals, the user can still participate in a game, at the reduced cost, if he does not intend to spend much money. He enters the enjoyment of the game, without the usual high financial outlay, so that the standard of the entertainment available to him is improved during this favoured rate of passage of time.

An alternative solution to the problem according to the invention consists in that the control device in the entertainment system functions in such manner, that for each use of the gaming device an extra game of chance is automatically set up and controlled, which, in the case of a win at this, would grant the user one or more free utilizations of the main gaming device.

By these features, for every use of the gaming system, a preliminary game will have taken place in the entertainment system before the main game takes place, and and quite independently of how much money has been inserted. The apparatus does not require any payment for these concessionary main games. The incentive to play and the quality of the resulting entertainment are thereby enhanced. By means of the preliminary play before the actual or principal game, the use of the equipment can be altogether richer in alternatives offered to the player, and produces exciting and substantial entertainment value.

Alternatively, the object of the invention is achieved by the central control device programming the automatic entertainment machine in such a way, that before the beginning of use of the gaming apparatus, it can be chosen by means of a selection switch whether the endpoint of the game should be determined by certain defined events in the game or by the passage of a predetermined period of time. By these features each person using the entertainment apparatus can freely determine if he wishes to entertain himself according to an allotted time, or according to the passage of the entertainment itself. If for example the apparatus includes a gaming device, the player can decide if his use of the equipment should be completed when the game ends, or if his use should be stopped after a predetermined time. The scope of possible playing by the user is thus increased and concomitantly the value of the entertainment given by the equipment is enhanced. New elements can be brought into the games by the user by inclusion of the above facilities. He can set himself the problem of achieving certain objectives within the allowed time. The user can thus himself create a new experience in entertainment, so that the attractiveness of playing is heightened. The user can use the equipment alternately in one way and then in the other way, in order to get to play under the various conditions, and he can for example apply the use-against-time condition so as to study the game and to rehearse certain courses of play.

With the object of increasing yet further the drawing power of the game, and therefore the value of the entertainment, one advantageous proposal within the scope of the invention allows the time during which the apparatus is to be used at reduced cost, to be indicated on the equipment, and the entertainment unit is accordingly distinctively illuminated or emits distinctive acoustic signals, for whatever period of time this reduced price utilization is permitted.

With a preferred embodiment of the invention, the game of chance established features a circle which resembles a roulette wheel or drum, and around which a light point or spot circulates. This light spot finally comes to rest, and thereby denotes a winning area at one position on the circle. This embodiment thereby enables an additional, optical incentive to play, which attracts attention to itself and which is at the same time especially simple to put into effect by means of the central control unit.

If the time interval granted according to a selection has determined when the game is to come to an end, the central control unit automatically divides the time thus granted among two or more participating users of the entertainment machine; then the possibilities for variations in the format in which the game takes place become even more abundant. The result is correspondingly improved recreation quality.

Having regard to the background, that the automatic entertainment is set up as a gaming apparatus and perhaps also that the gaming apparatus is set up to operate a game without a financial reward, the proposed features are especially effective for raising the value of the amusement available from an automatic or coin-fed entertainment machine.

BRIEF DESCRIPTION OF THE DRAWING

The fundamental idea of the invention will be further explained in the following description of an embodiment, given by way of example, and which is illustrated in the drawing.

The sole FIGURE is a perspective view illustrating an automatic entertainment machine in accordance with one embodiment of the present invention.

DESCRIPTION OF A PREFERRED EMBODIMENT

Reference number 1 designates an automatic entertainment machine in accordance with one embodiment of the present invention. This embodiment is operated by employment of a gaming device such as dart throwing equipment 2. This dart throwing equipment consists of a base 3 having a unit 4 on it carrying a dart target disc or board 5. On a control panel 6 there are arranged a play selection switch 7, a points score indicator 8 and other indicators and manual switches necessary for the play.

On the side of the base 3, there are housed coin insertion slots 9 and coin return containers 10 for use with the gaming equipment.

The dart board 5 is divided into various segments 11 and sectors or sections of the segments 12. These segments 11 and sections 12 are installed movably on a rubber sheet. Behind the rubber sheet there is fixed a switching matrix likewise not shown. If a dart impinges on one of the segments 11 or sectors 12 on the dart board 5, such segment 11 or sector 12 is moved on the rubber sheet, depresses the latter inwards, and actuates one or more switches in the switch matrix.

The darts game procedure is established by a central control unit 20 which supervises the entire course of play. This control unit 20 constantly interrogates the switching matrix behind the dart board 5. As soon as one of the switches in the switch matrix is actuated, the control unit 20 calculates the point count with the help of a stored program in correspondence with the manner of playing that has been chosen with the selector switch 7, and it displays this point count, attributed to the correct player, on the point count indicator unit 8.

On a further panel 13, a legend 14 such as "Happy Hour" is attached, and also a representation of a clock 15, which displays a certain time. The central control unit 20 of the darts playing equipment is arranged to allow play at the indicated time to be at reduced costs. The "Happy Hour" legend 14 can be illuminated. The illumination thereof takes place automatically, set up by the central control unit 20 at the outset of the reduced price period, and is extinguished again when this reduced cost period expires. To indicate this period, the central control unit 20 can sound a certain melody through ordinary loudspeakers throughout this period.

Apart from the "Happy Hour" legend 14, the exterior of the panel 13 carries also a selector switch 16. This selector switch is set up as a control switch for choosing alternatives. With this, one can choose before a period of use of the gaming equipment, whether predetermined occurrences during the passage of the game, for instance whether the end of the game should follow some given rule of play, or whether the lapse of a given time interval should dictate a termination of use for the dart playing equipment. If a period of play rather than a rule of play is chosen, the central control unit 20 can be arranged such as to allot the allowed time in several short periods or in a few single long time periods between two or more competing players.

Finally the panel 13 also is equipped with a circle 17 of individual illuminated spots or segments 18. For each use of the darts playing equipment, a randomly controlled game to win is established automatically on this circle, and if the user achieves a win at this, he claims one or more free uses of the dart playing equipment. The circle resembles a roulette wheel. The light points that can be illuminated under control of the control unit 20, are energized in rapid sequence one after another, so that the impression is given of one single rotating light spot. The speed of the simulated rotations slows down until the apparently rotating spot of light, under the central control, comes to rest at a position of one of the points or segments at random. This point is indicated as the winning one, by an arrow 19. If the randomly controlled rotating spot of light has come to rest where the arrow is pointing, the central control unit 20 will award one or more free games of darts.

What we claim is:

1. A coin-operated automatic entertainment machine, comprising: a gaming device; a central control unit; and selector switch means, cooperating with the central control unit, for manually preselecting whether an event in the play on the gaming device or a predetermined time span of play will determine the end of the game, wherein if a predetermined time span has been preselected to determine the end of the game, the predetermined time span is automatically divided among two or more participating players on the automatic entertainment machine.

2. A coin-operated automatic entertainment machine according to claim 1, wherein the entertainment machine is equipped as a gaming apparatus with a gaming device.

3. A coin-operated automatic entertainment machine according to claim 1, wherein the entertainment machine is equipped as a gaming apparatus without the winning of money.

4. A coin-operated automatic entertainment machine according to claim 1, wherein the gaming device comprises an electronic dart board.

* * * * *